US011401130B2

(12) United States Patent
Wetekam

(10) Patent No.: US 11,401,130 B2
(45) Date of Patent: Aug. 2, 2022

(54) MULTISPOOL CABINET FOR WINDING A FILAMENT ONTO A TRANSPORT SPOOL AND BUFFER SPOOL FOR SAME

(71) Applicant: Karl Friedrich Rolf Wetekam, Melsungen (DE)

(72) Inventor: Karl Friedrich Rolf Wetekam, Melsungen (DE)

( * ) Notice: Subject to any disclaimer, the term of this patent is extended or adjusted under 35 U.S.C. 154(b) by 125 days.

(21) Appl. No.: 16/985,273

(22) Filed: Aug. 5, 2020

(65) Prior Publication Data

US 2021/0053792 A1 Feb. 25, 2021

(30) Foreign Application Priority Data

Aug. 20, 2019 (DE) ..... 10 2019 122 337.7

(51) Int. Cl.

| | |
|---|---|
| ***B65H 54/86*** | (2006.01) |
| ***B65H 54/10*** | (2006.01) |
| ***B65H 67/04*** | (2006.01) |
| ***B65H 75/14*** | (2006.01) |
| ***B65H 67/052*** | (2006.01) |

(52) U.S. Cl.

CPC ..... *B65H 54/86* (2013.01); *B65H 54/106* (2013.01); *B65H 67/04* (2013.01); *B65H 67/052* (2013.01); *B65H 75/148* (2013.01); *B65H 2701/31* (2013.01)

(58) Field of Classification Search

CPC .... B65H 54/346; B65H 54/86; B65H 54/106; B65H 67/04; B65H 67/044; B65H 67/052; B65H 67/056; B65H 75/148

See application file for complete search history.

(56) References Cited

U.S. PATENT DOCUMENTS

| | | | |
|---|---|---|---|
| 3,620,482 | A | 11/1971 | Bravin |
| 4,119,278 | A | 10/1978 | Draizen et al. |
| 4,979,687 | A | 12/1990 | Birch |
| 2010/0308151 | A1 | 12/2010 | Döring et al. |
| 2013/0313354 | A1 | 11/2013 | Ludwig et al. |

FOREIGN PATENT DOCUMENTS

| | | | |
|---|---|---|---|
| CN | 206606853 | U | 11/2017 |
| CN | 108840169 | A | 11/2018 |
| DE | 1203566 | B | 10/1965 |
| DE | 10 2011 000 590 | B3 | 5/2012 |

(Continued)

OTHER PUBLICATIONS

English (machine) translation of DE 1203566 B.

(Continued)

*Primary Examiner* — William E Dondero

(74) *Attorney, Agent, or Firm* — Reising Ethington P.C.

(57) ABSTRACT

The subject matter of the invention is a manual multispool cabinet for winding a number of filaments (40, 40*a*) onto a respective removable transport spool (14, 14*a*) having a driven main winding shaft (10, 10*a*) per transport spool (14, 14*a*), wherein the main winding shaft (10, 10*a*) is formed for an exactly fitting reception of the transport spool (14, 14*a*, 214), and wherein the main winding shaft (10, 10*a*) drives the transport spool (14, 14*a*). Providing such a manual multispool cabinet that has such an increased filament speed is achieved in that, in addition to the transport spool (14, 14*a*), a buffer spool (12, 12*a*) is held on the main winding shaft (10, 10*a*).

12 Claims, 8 Drawing Sheets

(56) References Cited

FOREIGN PATENT DOCUMENTS

TW 578800 U 3/2004

OTHER PUBLICATIONS

Search Report issued in corresponding European Patent Application No. EP 2018829 (dated Dec. 2, 2020).
English (machine) translation of DE 10 2011 000 590 B3.
Search Report issued in corresponding Taiwanese App. No. 109128279.
English (translation) of Search Report issued in corresponding Taiwanese App. No. 109128279.
English language abstract of CN 206606853 U.
English language abstract of CN 1088410169 A.

MULTISPOOL CABINET FOR WINDING A FILAMENT ONTO A TRANSPORT SPOOL AND BUFFER SPOOL FOR SAME

BACKGROUND OF THE INVENTION a. Field of the Invention

The present invention relates to a buffer spool for receiving a filament and to a multispool cabinet for winding a number of filaments onto a respective transport spool.

b. Background Art

A multispool cabinet for winding a winding material onto a transport spool is known from DE 10 2009 026 849 B3 that has two winding stations and a changing device, wherein the filament is conducted from the full transport spool of the first winding station by the change device onto the second winding station having an empty transport spool so that the full transport spool can be removed and replaced with an empty transport spool.

A multispool cabinet for winding a winding material onto a transport spool is known from DE 10 2011 000 590 B3 that has at least two spindles per winding station for receiving a respective transport spool. The winding material is therefore first wound onto the transport spool located on the first spindle and, when it is full, the winding material is conducted onto the transport spool of the second spindle. The first, full transport spool can now be replaced with an empty transport spool, etc.

Such a multispool cabinet is cost-intensive and susceptible to problems due to the very complex changing device, on the one hand, and two winding stations disposed next to one another are required, on the other hand, of which one remains permanently unused, which requires very large space requirements.

Multispool cabinets are also known in which the change of the spool takes place manually (called a manual multispool cabinet in the following) so that a spool changing device is not necessary. These manual multispool cabinets can accommodate considerably more transport spools with an unchanged size and can thus compensate some of the additional costs incurred due to the manual change. Alternatively, the manual multispool cabinets can be of a very much smaller design with an unchanged number of spools so that the free length of the filament from the extruder to the transport spool becomes shorter, which in turn effects an operation less prone to problems so that some of the additional costs incurred by the manual change can be compensated. So that the change of the transport spool can take place manually, the feed speed of the filament has to be limited to a maximum of 180 m/min to avoid injuries to the operator.

Starting from this, it is the underlying object of the present invention to provide a manual multispool cabinet of the initially named kind that can be operated at a higher feed speed.

BRIEF SUMMARY OF THE INVENTION

In accordance with the invention, a buffer spool of the initially named kind having the features of claim 1 and a manual multispool cabinet of the initially named kind having the features of claim 7 are proposed as the technical achievement of this object. Advantageous further developments of this buffer spool and of this multispool cabinet can be seen from the respective dependent claims.

A manual multispool cabinet configured in accordance with this technical teaching has the advantage that a second spool, namely a buffer spool, onto which the filament is wound while the full transport spool is exchanged for an empty transport spool, is now held on the main winding shaft anyway already present. The necessity of a second winding station is thus dispensed with, whereby the multispool cabinet can either be designed as considerably smaller or whereby considerably more transport spools can be operated in parallel.

A further advantage comprises the feed speed of the filament being increased up to 800 m/min depending on the thickness of the filament due to the buffer spool, whereby the efficiency of the manual multispool cabinet is significantly increased.

The change of a transport spool is performed as follows: As soon as the transport spool has been filled in the desired manner, the filament is diverted into the buffer spool by hand by an operator. The filament is subsequently cut and the full transport spool removed. An empty transport spool is then affixed to the main winding shaft and the filament is again conducted back to the transport spool from the buffer spool by hand by the operator so that from then on the filament is again wound onto the transport spool. The filament still located between the buffer spool and the transport spool is subsequently cut. As soon as this transport spool is full again, this procedure is repeated. In so doing, the filament wound onto the buffer spool during the change procedure remains permanently on this buffer spool until the buffer spool is full after a plurality of change procedures. The buffer spool is only also removed now and replaced with an empty buffer spool so that the filament can be removed from the buffer spool again at leisure outside the multispool cabinet.

30 to 80 change procedures can be carried out in accordance with the reception capacity of the buffer spool and in dependence on the thickness of the filament until the buffer spool is full and has to be replaced.

It has proven advantageous here to hold the buffer spool in a freely running manner on the main winding shaft because the speed of the buffer spool can hereby be set independently of the speed of the transport spool and because the buffer spool can also hereby be fixed. A constant feed speed of the filament is important to ensure a disruption-free transport of the high number of filaments of a multispool cabinet from the extruder to the respective transport spool. However, because the winding diameter of the transport spool changes, a speed adaptation of the transport spool takes place to keep the feed speed constant. The buffer spool is held in a freely running manner on the main winding shaft so that the speed of the buffer spool can also be correspondingly adapted to the feed speed in accordance with its filling level.

In a preferred embodiment, the buffer spool is driven independently of the main winding shaft, in particular by a separate electric drive that is operatively connected to the buffer spool via a belt. This has the advantage that the speed of the buffer spool can be adapted to the feed speed of the filament via its own electric drive independently of the transport spool.

A buffer spool configured in accordance with this technical teaching for affixing to a manual multispool cabinet comprises a spool core, a spool wall, a side wall, and a catching device for capturing the filament, with the spool core being bounded toward the multiple spool cabinet by the side wall, while the spool core is bounded toward the transport spool by the spool wall. The spool core itself is dimensioned such that the filaments of 30 to 80 transport spool changes can be received here, that is the spool core is considerably smaller than the comparable spool core of the transport spool.

The catching device supports the changing of the filament from the transport spool to the buffer spool and advantageously has a peripheral catching surface that radially adjoins the spool wall and/or the side wall, with the catching surface guiding an impinging filament toward the spool core.

In a preferred further development, such a catching surface for capturing the filament both radially adjoins the side wall and radially adjoins the spool wall. It has proved to be advantageous to configure the side wall with the associated catching surface as larger than the spool wall with the associated catching surface because an easier transfer of the filament is possible due to the smaller catching surface at the spool wall while the somewhat larger catching surface at the side wall reliably captures the filament.

This catching surface is advantageously not oriented exactly radially, but is rather oriented in an inclined manner, in particular oriented facing away from the spool core. in an inclined manner This has the advantage that the inlet region decisive for the filament is hereby increased. A further advantage comprises the inclined catching surface guiding a filament impinging thereon toward the spool core. The angle of the catching surface to the longitudinal axis of the main winding shaft advantageously amounts to between 20° and 45°, preferably 30°.

In a preferred embodiment, the catching device, in particular a radially outer margin of the catching device, reaches up to and over a part of the transport spool, in particular up to and over the transport spool side wall. The transfer of the filament from the rotating transport spool to the rotating buffer spool is hereby facilitated because an accidental sliding off of the filament during the transfer into a region between the transport spool and the buffer spool is hereby reliably avoided. The filament rather moves onto the protruding catching surface and is conducted onward by it toward the spool core of the buffer spool.

In a further preferred embodiment, a peripheral safety shoulder that is preferably configured as an edged or milled margin of the catching device is formed at the catching device, in particular at the radially outer margin of the catching device. In particular when this safety shoulder is configured as a peripheral thickened portion, this has the advantage that a sharp-edged termination of the catching device is hereby avoided so that, on the one hand, the operator cannot injure himself and, on the other hand, the filament is not accidentally cut on the change from the transport spool to the buffer spool.

It has also proved advantageous to crimp the safety shoulder so much around the catching surface that a peripheral annular groove is produced between the safety shoulder and the catching surface. This has the advantage that a filament that is already present on the catching surface cannot accidentally slip off from the catching surface and the buffer spool, but is rather tangled in the peripheral groove in this case.

In an alternative embodiment, the side wall and/or the spool wall is/are completely inclined and thus simultaneously forms/form the catching surface of the catching device. In other words: In this embodiment, the catching device inclined away from the spool core reaches up to the spool core so that the actual side wall is dispensable. This simplifies the manufacture of such a spool.

In another preferred embodiment, the spool core tapers conically toward the transport spool. This has the advantage that the filaments collecting on the spool core collect at the lowest point of the spool core and that thus an entangling or an accidental release of the filaments located in the spool is avoided.

Further advantages of the buffer spool in accordance with the invention and of the manual multispool cabinet in accordance with the invention result from the enclosed drawing and the embodiments described below. The above named features and the features still further discussed can equally be used individually or in any desired combinations with one another in accordance with the invention. The embodiments mentioned are not to be understood as an exclusive list, but rather have an exemplary character. There are shown:

DETAILED DESCRIPTION OF THE INVENTION

Figures 1, 1A:
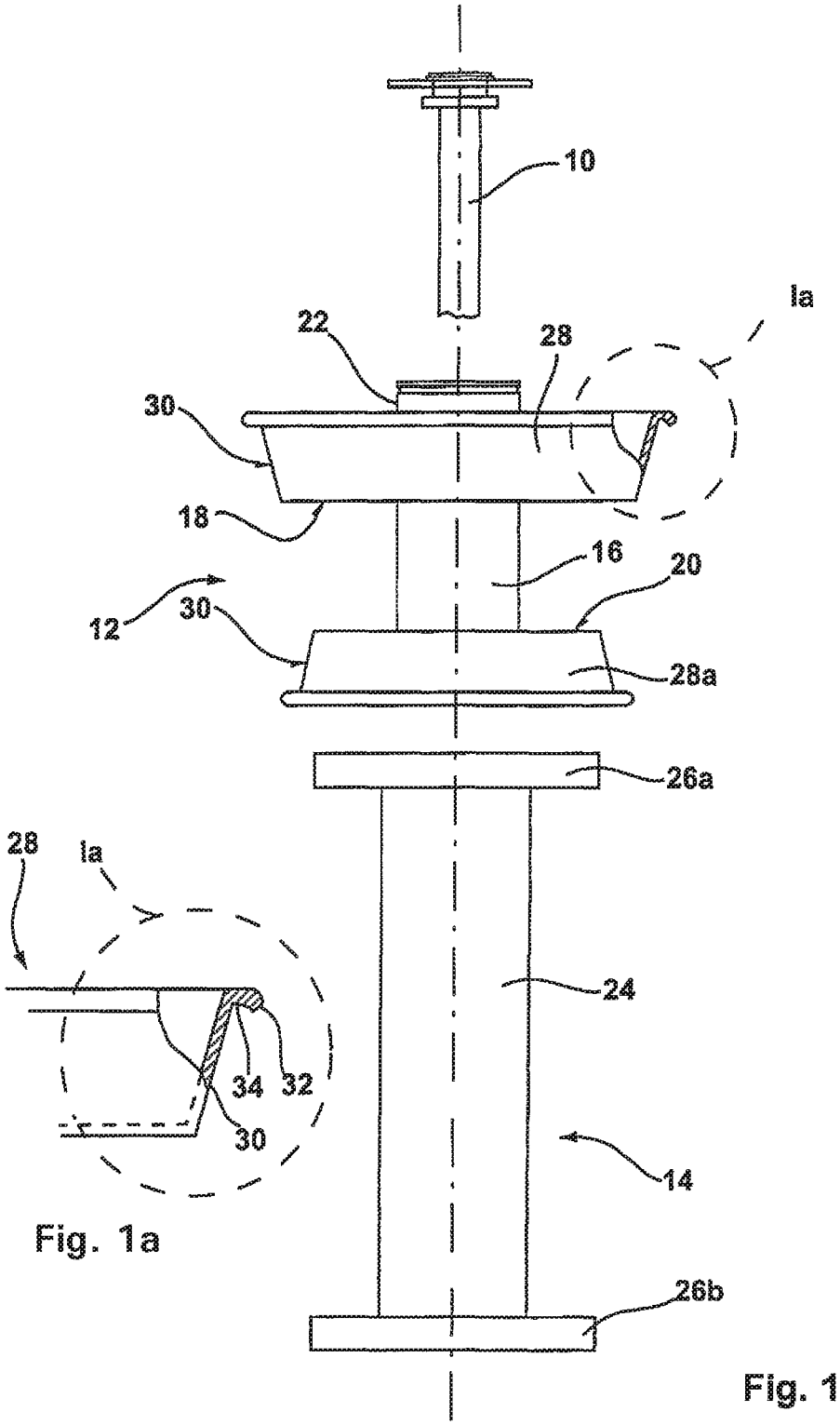
FIG. 1 is an exploded representation of a part of a multispool cabinet in accordance with the invention having a main drive shaft and a transport spool held thereat as well as a first embodiment of a buffer spool in accordance with the invention held thereat.
FIG. 1*a* is a detailed enlargement of the buffer spool in accordance with FIG. 1 corresponding to the line Ia in FIG. 1.

FIG. 1 shows a part of a manual multispool cabinet for winding a number of filaments onto a respective transport spool, wherein a main winding shaft 10, a buffer spool 12 affixable to the main winding shaft 10, and a transport spool 14 driven by the main winding shaft 10 are shown in FIG. 1. It is understood that up to 100 such main winding shafts having buffer spools 12 and transport spools 14 to be received thereat are present at such a multispool cabinet.

The first embodiment of a buffer spool 12 in accordance with the invention shown in FIG. 1 comprises a spool core 16, a radially projecting side wall 18 bounding the spool core 16 toward the multispool cabinet, a radially projecting spool wall 20 bounding the spool core 16 toward the transport spool 14, and a belt pulley 22 fixedly affixed to the buffer spool 12 to receive a belt of an electric drive. The buffer spool 12 has different roller element bearings in its interior (not shown here) so that the buffer spool 12 is seated in a freely running manner on the main winding shaft 10. The main winding shaft 10 is designed as so long that, in addition to the buffer spool 12, the transport spool 14 can also be held with an exact fit and reliably on the main winding shaft 10. The transport spool 14 here comprises a transport spool core 24 for receiving the filament that is bounded by a right hand and a left hand radially projecting transport spool side wall 26*a*, 26*b*.

A catching device 28 that has a peripheral catching surface 30, a peripheral safety shoulder 32, and a peripheral annular groove 34 is provided at the side wall 18 of the buffer spool 12. The catching surface 30 radially adjoins the side wall 18 at the radially outer margin in an inclined manner and is arranged inclined away from the spool core 16 in an axial direction, with the angle to the longitudinal axis of the main winding shaft 10 amounting to between 20° and 45°, preferably 30°. A peripheral annular groove 34 is formed at the free end of the catching surface 30, as can be easily recognized in FIG. 1*a*. A peripheral safety shoulder 32 adjoins the radial free end of the annular groove 34.

In the embodiment shown in FIG. 1 here, such a catching device 38 of the same design is also provided at the spool wall 20.

Figure 2:
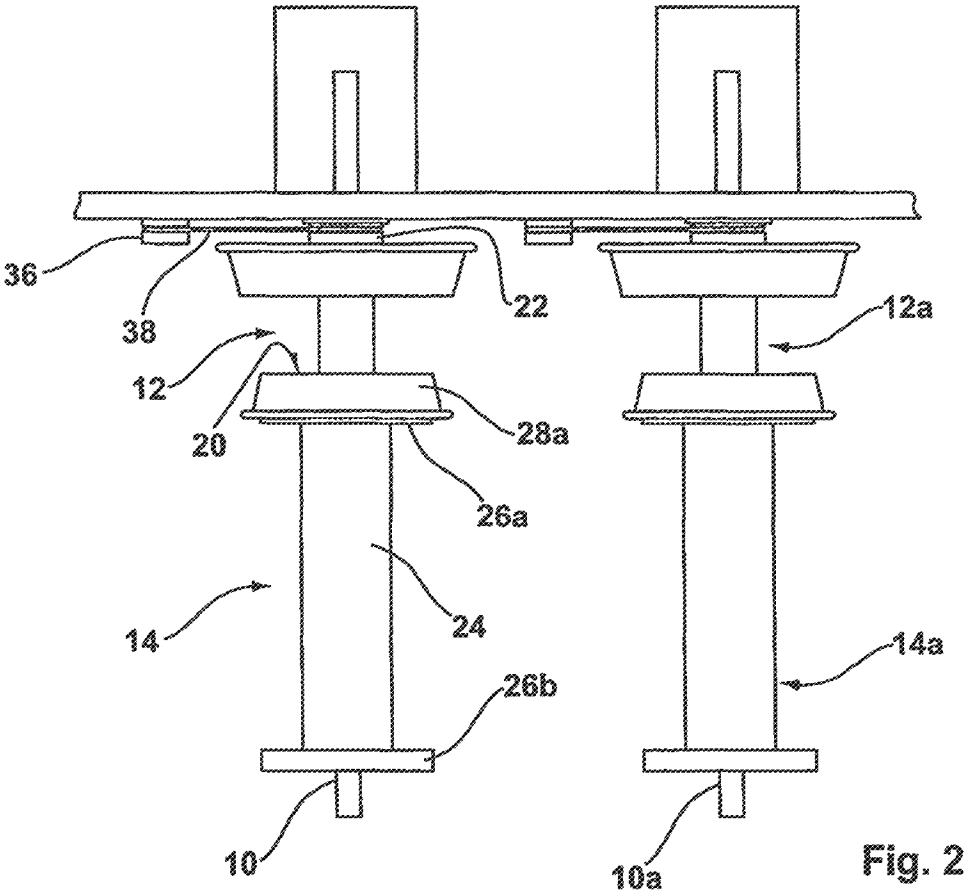
FIG. 2 is a plan view of two adjacent transport spools of the multispool cabinet in accordance with FIG. 1, each having a buffer spool in accordance with FIG. 1. in a state of rest.

FIG. 2 shows a part of the multi spool cabinet having two main winding shafts 10, 10*a* arranged next to one another and buffer spools 12, 12*a* and transport spools 14, 14*a* placed thereon. As can be easily recognized here, the buffer spool 12 held in a freely running manner on the main winding shaft 10 is driven by a separate electric drive 36, with the electric drive 36 being connected to the buffer spool 12 via a belt 38 seated in the belt pulley 22. The same applies analogously to the buffer spool 12*a*.

As can in particular be recognized in FIGS. 1 and 2, the side wall 18 with the catching device 28 affixed thereto is somewhat larger than the spool wall 20 with the catching device 28*a* affixed thereto.

As can in particular be easily recognized in FIG. 2, the catching device 28*a* of the spool wall 20 reaches considerably up to and over the transport spool side wall 26*a* of the transport spool 24 so that the gap between the buffer spool 12 and the transport spool 14 is covered hereby.

As can be easily recognized in FIGS. 1 and 2, and in particular in FIG. 1*a*, the safety shoulder 32 is designed as a peripheral thickened portion and should thus prevent injury to the operator or an accidental cutting of the filament.

The peripheral annular groove 34 of the catching device 28 should prevent filaments located on the catching surface 30 from moving away from the buffer spool 12. As soon as these filaments arrive at the annular groove 34, they are stopped accordingly. The catching surface 30 inclined by between 20° and 45°, preferably 30°, with respect to the longitudinal axis of the main winding shaft 10 should have the effect that a filament impinging thereon is conducted toward the spool core 16.

Such a change of the transport spool will be described in detail as follows in the following in FIGS. 3*a* to 3*d:*

Figure 3A:
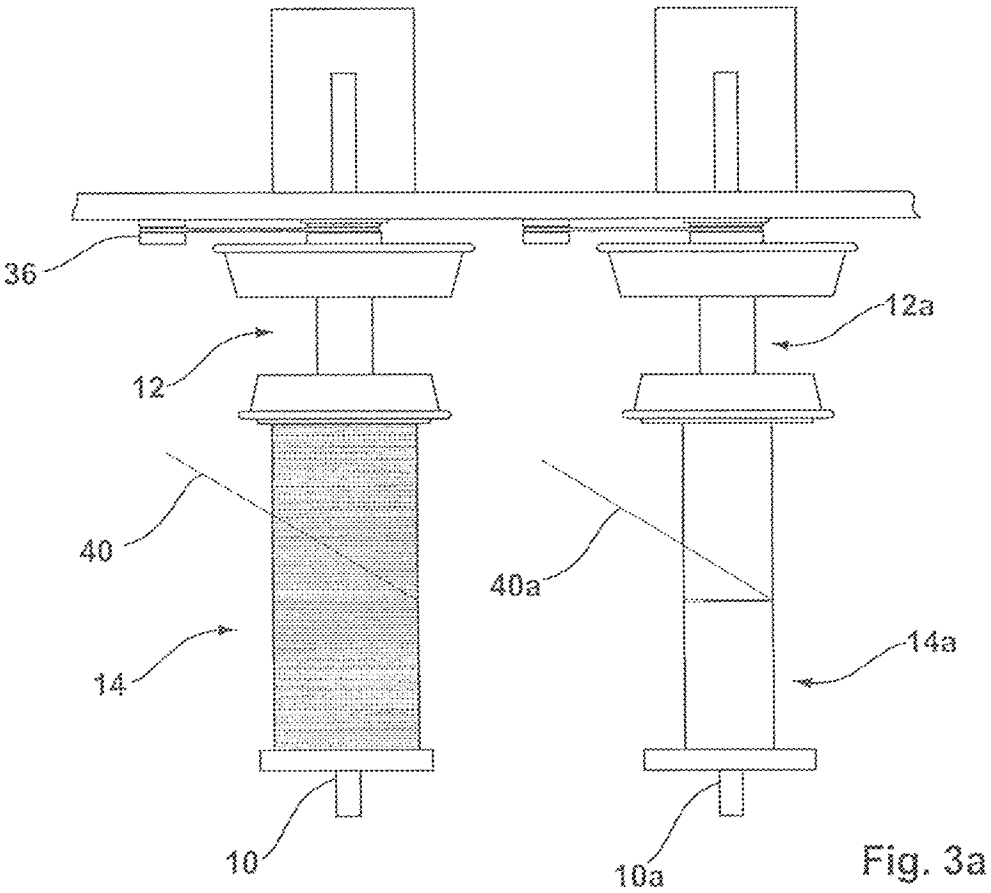
FIG. 3*a* is a plan view of two adjacent transport spools of the multispool cabinet in accordance with FIG. 1, each having a buffer spool in accordance with FIG. 1, in the operating state at a first point in time.

Two main winding shafts 10 and 10*a* arranged in parallel are shown in FIGS. 3*a* to 3*d*, wherein, as can be recognized in FIG. 3*a*, the main winding shaft 10 carries an already full transport spool 14 while the transport spool 14*a* of the main winding shaft 10*a* had only been recently changed and only comprises a small amount of filament 40*a*. An operator now moves in and switches the electric drive 36 on so that the buffer spool 12 starts to rotate. In this respect, the speed of the buffer spool 12 is set in dependence on the degree of filling such that the filament 40 can be received at the current feed speed. As soon as the desired speed has been reached, the operator grasps the filament 40 and conducts it to the buffer spool 12 while the transport spool 14 continues to rotate at a different speed. The filament 40 can here reach a feed speed of up to 800 m/min.

Figure 3B:
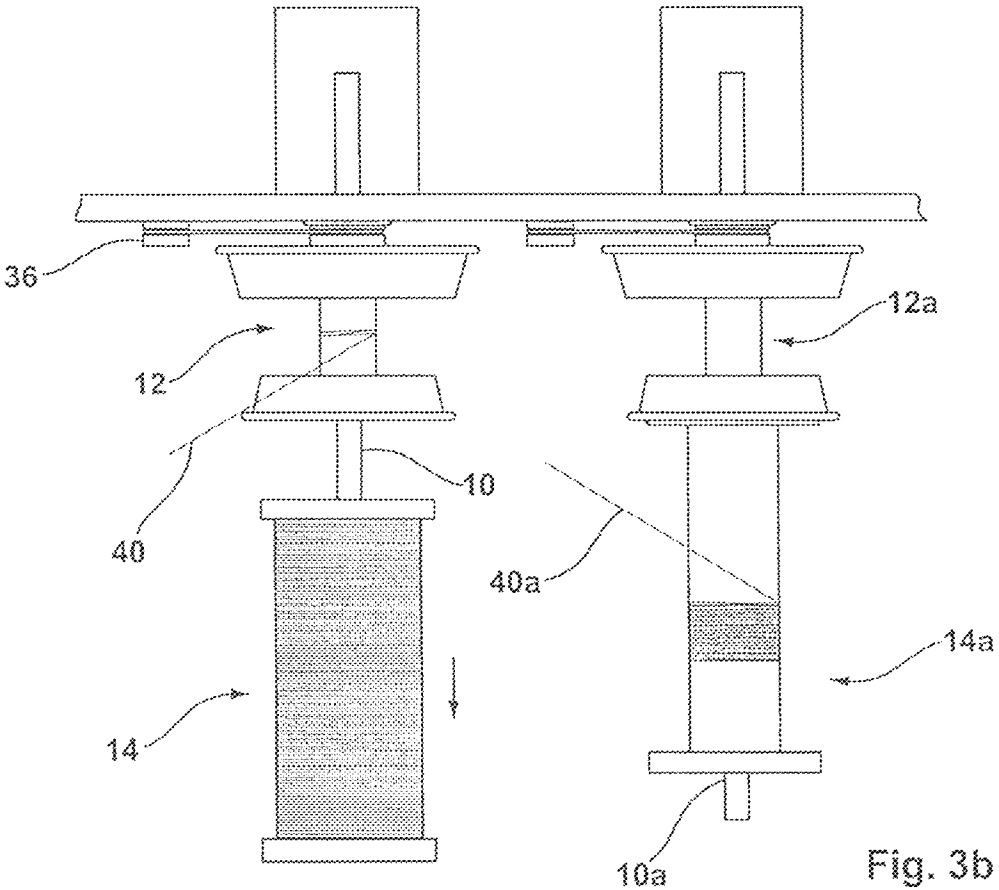
FIG. 3*b* is a plan view of two adjacent transport spools of the multispool cabinet in accordance with FIG. 1, each having a buffer spool in accordance with FIG. 1, in the operating state at a second point in time.
Figure 3C:
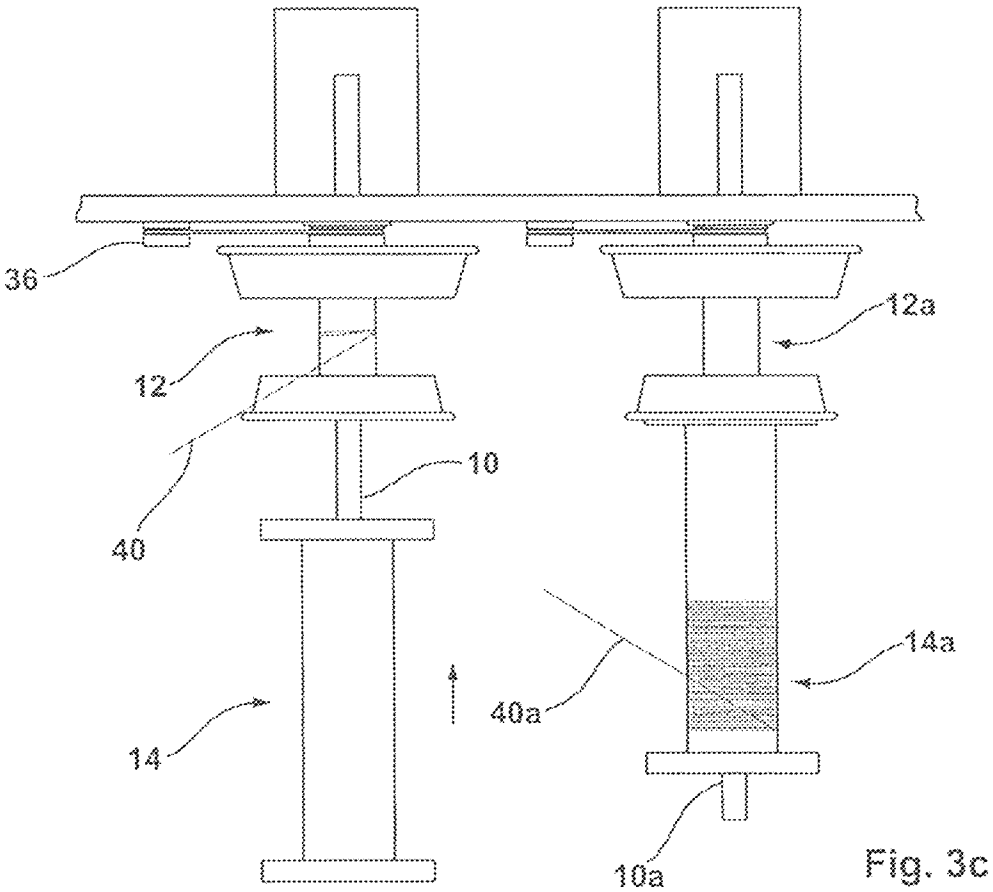
FIG. 3*c* is a plan view of two adjacent transport spools of the multispool cabinet in accordance with FIG. 1, each having a buffer spool in accordance with FIG. 1, in the operating state at a third point in time.
Figure 3D:
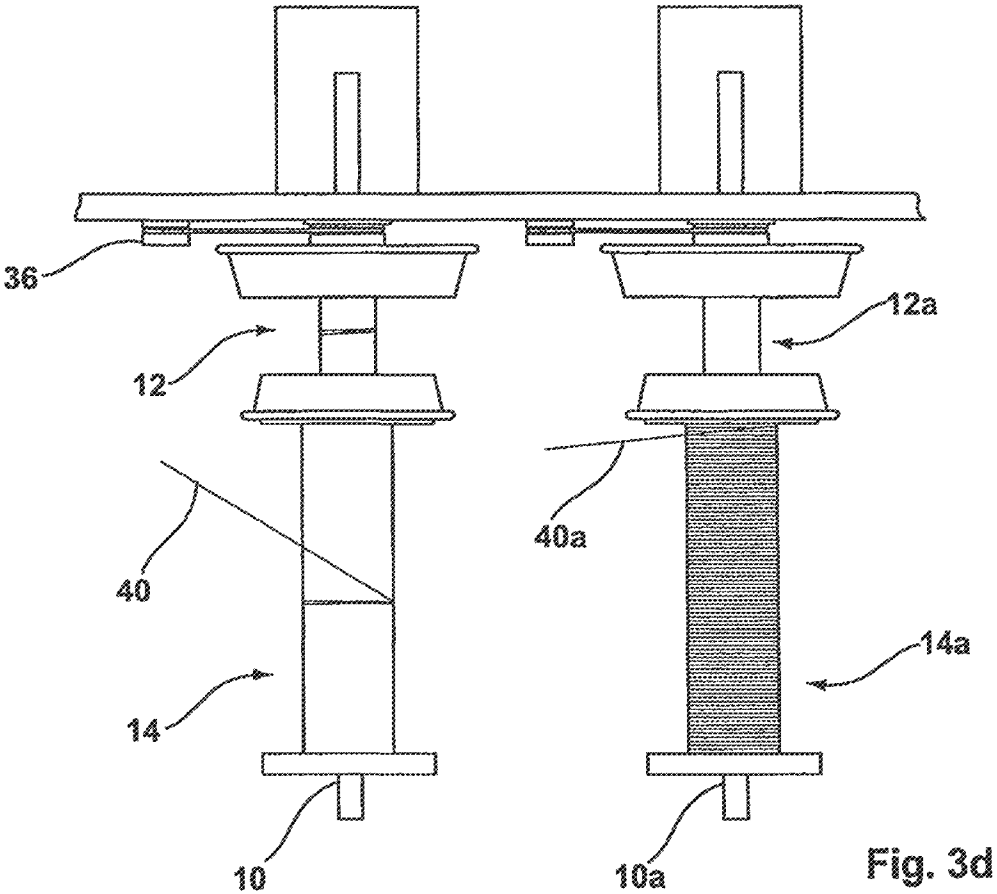
FIG. 3*d* is a plan view of two adjacent transport spools of the multispool cabinet in accordance with FIG. 1, each having a buffer spool in accordance with FIG. 1, in the operating state at a fourth point in time.

As can be seen from FIG. 3*b*, the filament 40 is from now on wound onto the buffer spool 12. Once the filament 40 has been cut in the region of the transport spool 14, the transport spool 14 can be removed from the main winding shaft 10 and can be replaced by an empty transport spool 14, as can be recognized in FIG. 3*c*. The parallel transport spool 14*a* on the main winding shaft 10*a* remains unaffected by this and continues to receive a different filament 40*a* in the customary manner at a speed of up to 800 m/min. The operator subsequently conducts the filament 40 from the buffer spool 12 onto the empty transport spool 14 and subsequently cuts the filament 40 so that the filament 40 is wound on the transport spool 14 in the customary manner. During this procedure, some of the filament 40 is wound onto the buffer spool 12 and remains there. After the completed change of the transport spool 14, the electric drive 36 is switched off as soon as the buffer spool 12 does not permanently rotate along.

The buffer spool 12 is designed such that approximately 30 to 80 transport spool changes can be carried out before the buffer spool 12 is full and has to be emptied itself. This entire procedure takes place in ongoing operation, with the filament 40 being wound onto the transport spool 14 at a speed of up to 800 m/min.

Figure 4:
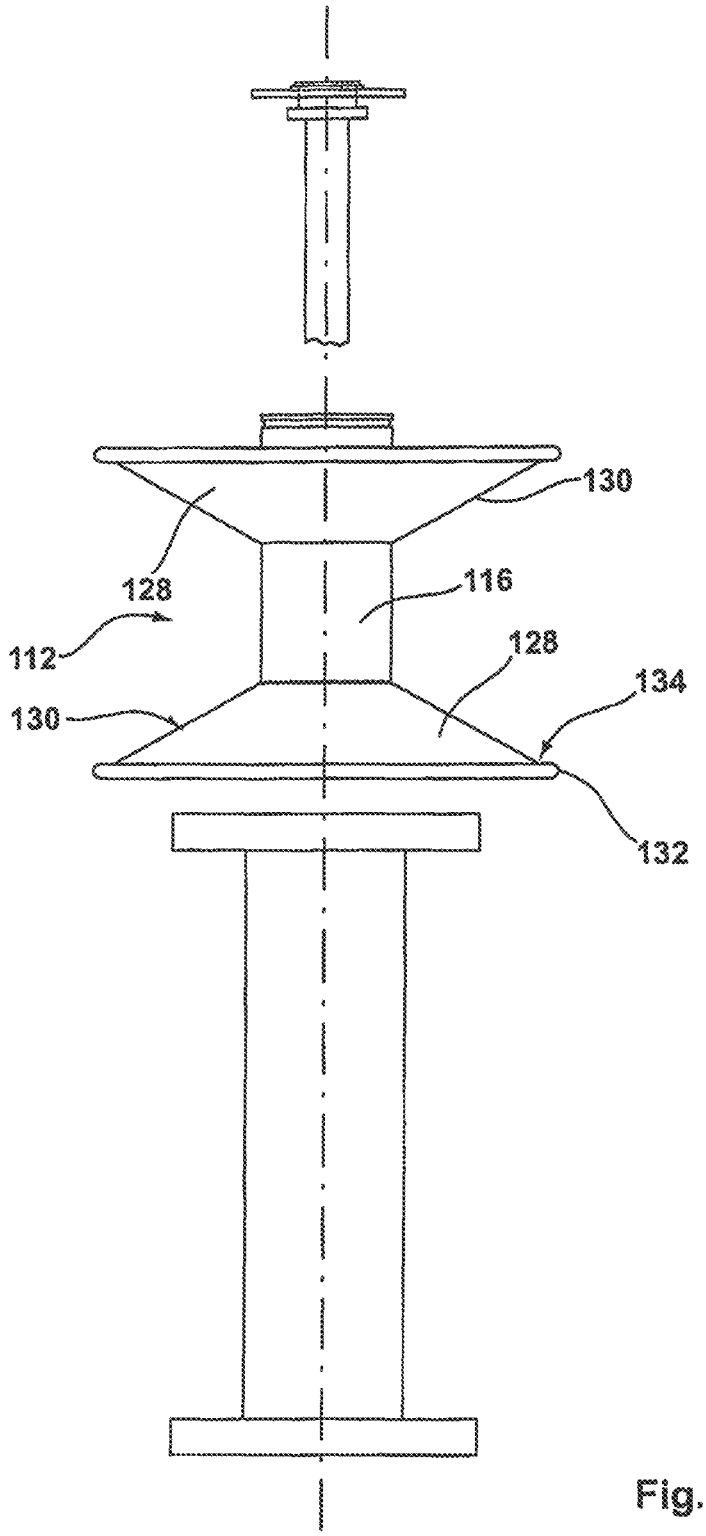
FIG. 4 is an exploded representation of a part of a multispool cabinet in accordance with the invention having a main drive shaft and a transport spool held thereat, and a second embodiment of a buffer spool in accordance with the invention held thereat.

A second embodiment of a buffer spool 112 is shown in FIG. 4 in which a side wall and a spool wall were dispensed with and wherein the catching device 128 is arranged directly radially projecting from the spool core 116 and is inclined away from the spool core 116. In this embodiment, the catching devices 128 are both formed the same and likewise have a catching surface 130, a safety shoulder 132, and an annular groove 134. To avoid repetition, reference is made in full to the catching device 28 in accordance with FIGS. 1 and 2.

Figure 5:
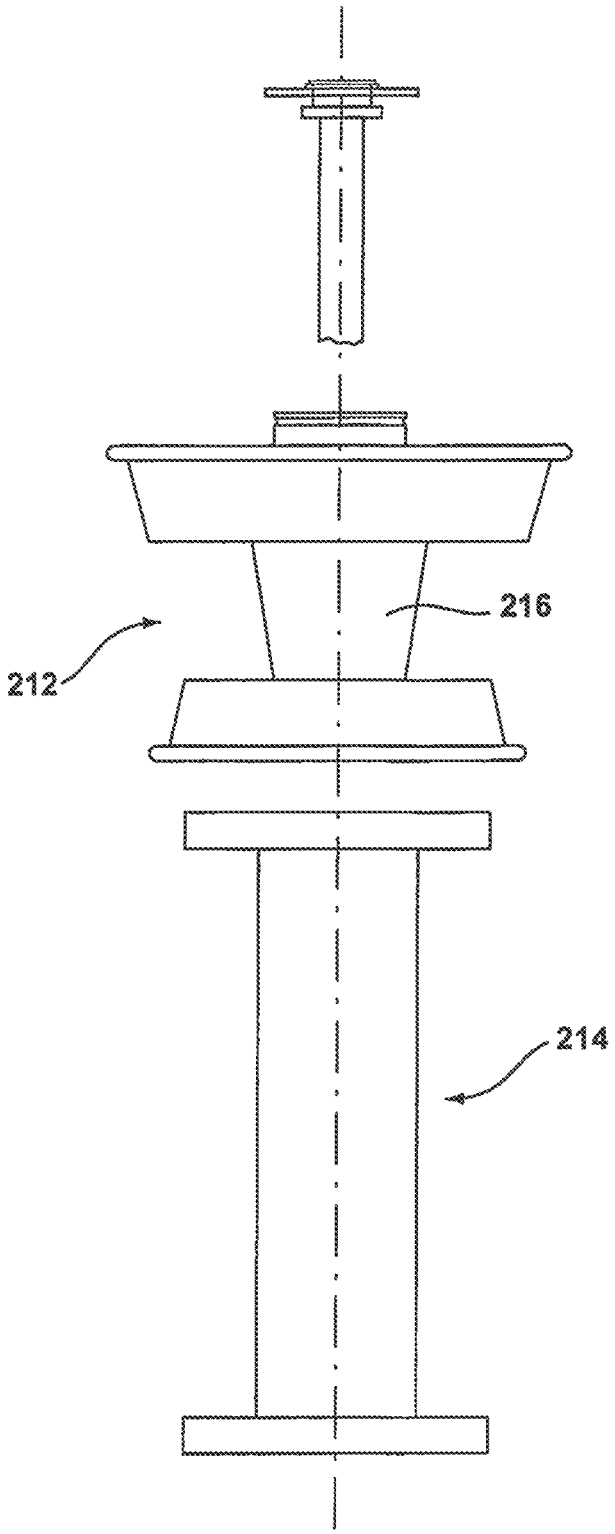
FIG. 5 is an exploded representation of a part of a multispool cabinet in accordance with the invention having a main drive shaft and a transport spool held thereat, and a third embodiment of a buffer spool in accordance with the invention held thereat.

A third embodiment of a buffer spool 212 in accordance with the invention is shown in FIG. 5 that, with the exception of the spool core 216 is identical to the first embodiment of the buffer spool 12 shown in FIGS. 1 and 2. Unlike the buffer spool 12, the spool core 216 of the buffer spool 212 tapers conically, with the narrow end being formed toward the transport spool 214.

REFERENCE NUMERAL LIST

10, 10*a* main winding shaft
12, 12*a*, 112, 212 buffer spool
14, 14*a*, 214 transport spool
16, 116, 216 spool core
side wall
spool wall belt pulley
transport spool core
26*a*, 26*b* transport spool side wall
28, 28*a*, 128 catching device
30, 130 catching surface
32, 132 safety shoulder
34, 134 annular groove
36 electric drive
38 belt
40, 40*a* filament

What is claimed is:

1. A buffer spool (12, 12*a*, 112, 212) for affixing to a manual multispool cabinet and for receiving a filament (40, 40*a*) comprising:

a spool core (16, 116, 216);

a side wall (18, 318) bounding the spool core (16, 116, 216) toward the multispool cabinet;

a spool wall (20) bounding the spool core (16, 116, 216) toward a transport spool (14, 14*a*, 214); and, a catching device (28, 28*a*, 128) for capturing the filament (40, 40*a*)

characterized in that the catching device (28, 28*a*, 128) has a peripheral safety shoulder (32, 132) that is arranged at the radially outer margin of the catching device (28, 28*a*, 128), and in that a peripheral annular groove (34, 134) is formed between the safety shoulder (32, 132) and a catching surface (30, 130).

2. The buffer spool (12, 12*a*, 112, 212) of claim 1, characterized in that the catching surface (30, 130) of the catching device (28, 28*a*, 128) radially adjoins the side wall (18, 318) in an inclined manner and runs around the side wall (18, 318) for capturing the filament (40, 40*a*) and for conducting the filament (40, 40*a*) onward to the spool core (16, 116, 216); and/or in that the catching surface (30, 130) of the catching device (28, 28*a*, 128) radially adjoins the spool wall (20, 320) in an inclined manner and runs around the spool wall (20, 320) for capturing the filament (40, 40*a*) and for conducting the filament (40, 40*a*) onward to the spool core (16, 116, 216); and in that the catching surface (30, 130) is arranged facing away from the spool core (16, 116, 216) in an inclined manner.

3. The buffer spool (12, 12*a*, 112, 212) of claim 1, characterized in that a radially outer margin of the catching device (28, 128) reaches up to and over a part of the transport spool (14, 14*a*, 214).

4. The buffer spool (12, 12*a*, 112, 212) of claim 1, characterized in that the side wall (18, 318) and/or the spool wall (20) is/are formed in a manner fully or partially inclined away from the spool core (16, 116, 216) to capture the filament (40, 40*a*).

5. The buffer spool (12, 12*a*, 112, 212) of claim 1, characterized in that the spool core (216) tapers conically toward the transport spool (214).

6. The buffer spool (12, 12*a*, 112, 212) of claim 1, characterized in that the catching surface (30, 130) runs around the entire circumference of the side wall (18, 318) and/or runs arounds the entire circumference of the spool wall (20, 320).

7. A manual multispool cabinet for winding a filament (40, 40*a*), comprising:

a removable transport spool (14, 14*a*, 214) configured to receive the filament (40,40*a*);

a driven main winding shaft (10, l0*a*) configured for an exactly fitting reception of the transport spool (14, 14*a*, 214), and wherein the main winding shaft (10, l0*a*) drives the transport spool (14, 14*a*, 214); and, a buffer spool (12, 12*a*, 112, 212) held on the main winding shaft (10, l0*a*), the buffer spool (12, 12*a*, 112, 212) including, a spool core (16, 116, 216);

a side wall (18, 318) bounding the spool core (16, 116, 216) toward the multispool cabinet;

a spool wall (20) bounding the spool core (16, 116, 216) toward the transport spool (14, 14*a*, 214); and, a catching device (28, 28*a*, 128) for capturing the filament (40, 40*a*)

characterized in that the buffer spool (12, 112, 212) is driven independently of the main winding shaft (10*a*, 10*b*).

8. The multispool cabinet of claim 7, characterized in that the buffer spool (12, 12*a*, 112, 212) is held in a freely running manner on the main winding shaft (10, 10*a*).

9. The multispool cabinet of claim 7, characterized in that the buffer spool (12, 12*a*, 112, 212) is driven via its own electric drive (36) with the electric drive (36) being operatively connected to a belt pulley (22) affixed to the buffer spool (12, 12*a*, 112, 212) via a belt (38).

10. The multispool cabinet of claim 7 characterized in that the catching device (28, 28*a*, 128) has a catching surface (30, 130) radially adjoining the side wall (18, 318) in an inclined manner and running around the side wall (18, 318) for capturing the filament (40, 40*a*) and for conducting the filament (40, 40*a*) onward to the spool core (16, 116, 216) and/or in that the catching device (28, 28*a*, 128) has a catching surface (30, 130) radially adjoining the spool wall (20, 320) in an inclined manner and running around the spool wall (20, 320) for capturing the filament (40, 40*a*) and for conducting the filament (40, 40*a*) onward to the spool core (16, 116, 216).

11. The multispool cabinet of claim 10 characterized in that the catching surface (30, 130) extends between the side wall (18, 318) and the spool core (16, 116, 216) at a constant angle and/or extends between the spool wall (20, 320) and the spool core (16, 116, 216) at a constant angle.

12. The multispool cabinet of claim of claim 11, characterized in that the catching surface (30, 130) runs around the entire circumference of the side wall (18, 318) and/or runs arounds the entire circumference of the spool wall (20, 320).

* * * * *